US007105042B2

(12) United States Patent
Tumbrink et al.

(10) Patent No.: US 7,105,042 B2
(45) Date of Patent: Sep. 12, 2006

(54) APPARATUS FOR SEPARATING AEROSOLS OR PARTICLES FROM GASES

(75) Inventors: Manfred Tumbrink, Bad König (DE); Heinz Fissan, Kerken (DE); Frank Jordan, Erkrath (DE); Christoph Kleinert, Mülheim an der Ruhr (DE)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/041,092

(22) Filed: Jan. 18, 2005

(65) Prior Publication Data

US 2005/0235829 A1 Oct. 27, 2005

Related U.S. Application Data

(63) Continuation of application No. PCT/EP03/07800, filed on Jul. 17, 2003.

(30) Foreign Application Priority Data

Jul. 18, 2002 (DE) ..... 102 32 602

(51) Int. Cl.
*B03C 3/06* (2006.01)

(52) U.S. Cl. ..... 96/96; 55/385.3; 55/DIG. 19; 55/DIG. 38; 96/97

(58) Field of Classification Search ..... 96/57, 96/61, 70, 87, 96, 97; 55/385.3, DIG. 19, 55/DIG. 38
See application file for complete search history.

(56) References Cited

U.S. PATENT DOCUMENTS

| | | | | | |
|---|---|---|---|---|---|
| 2,926,749 | A * | 3/1960 | Oswald | ..... | 96/98 |
| 3,308,344 | A * | 3/1967 | Smith et al. | ..... | 361/229 |
| 3,768,258 | A * | 10/1973 | Smith et al. | ..... | 60/275 |
| 3,782,905 | A * | 1/1974 | Huang et al. | ..... | 422/121 |
| 3,957,374 | A * | 5/1976 | Kriese et al. | ..... | 356/312 |
| 3,998,611 | A * | 12/1976 | Honacker | ..... | 96/48 |
| 4,072,477 | A * | 2/1978 | Hanson et al. | ..... | 95/71 |
| 4,317,661 | A | 3/1982 | Sasaoka et al. | ..... | 96/67 |
| 4,339,782 | A * | 7/1982 | Yu et al. | ..... | 96/62 |
| 4,955,991 | A * | 9/1990 | Torok et al. | ..... | 96/50 |
| 5,066,316 | A * | 11/1991 | Ikeda | ..... | 96/52 |
| 5,433,772 | A * | 7/1995 | Sikora | ..... | 96/87 |
| 5,934,261 | A | 8/1999 | Schumann et al. | ..... | 123/573 |
| 6,090,189 | A | 7/2000 | Wikstöm et al. | ..... | 96/69 |
| 2001/0020417 | A1 * | 9/2001 | Liu et al. | ..... | 96/66 |

FOREIGN PATENT DOCUMENTS

| | | | | |
|---|---|---|---|---|
| DE | 19642218 | | 4/1998 | |
| EP | 0685635 | | 12/1995 | |
| JP | 54-11571 | * | 1/1979 | ..... 96/97 |

* cited by examiner

*Primary Examiner*—Richard L. Chiesa
(74) *Attorney, Agent, or Firm*—Crowell & Moring LLP

(57) ABSTRACT

An apparatus for separating aerosols or particles from a gas stream composed of a flow housing through which the gas containing the components to be separated flows, a separator, which is arranged in the flow housing, and a corona electrode, which is provided upstream of the separator in the direction of flow. The corona electrode is located substantially outside the gas flow. An air volume stream from the corona electrode flows into to the gas flow to transport charge carriers generated by the corona electrode into a charging zone in the flow housing.

8 Claims, 1 Drawing Sheet

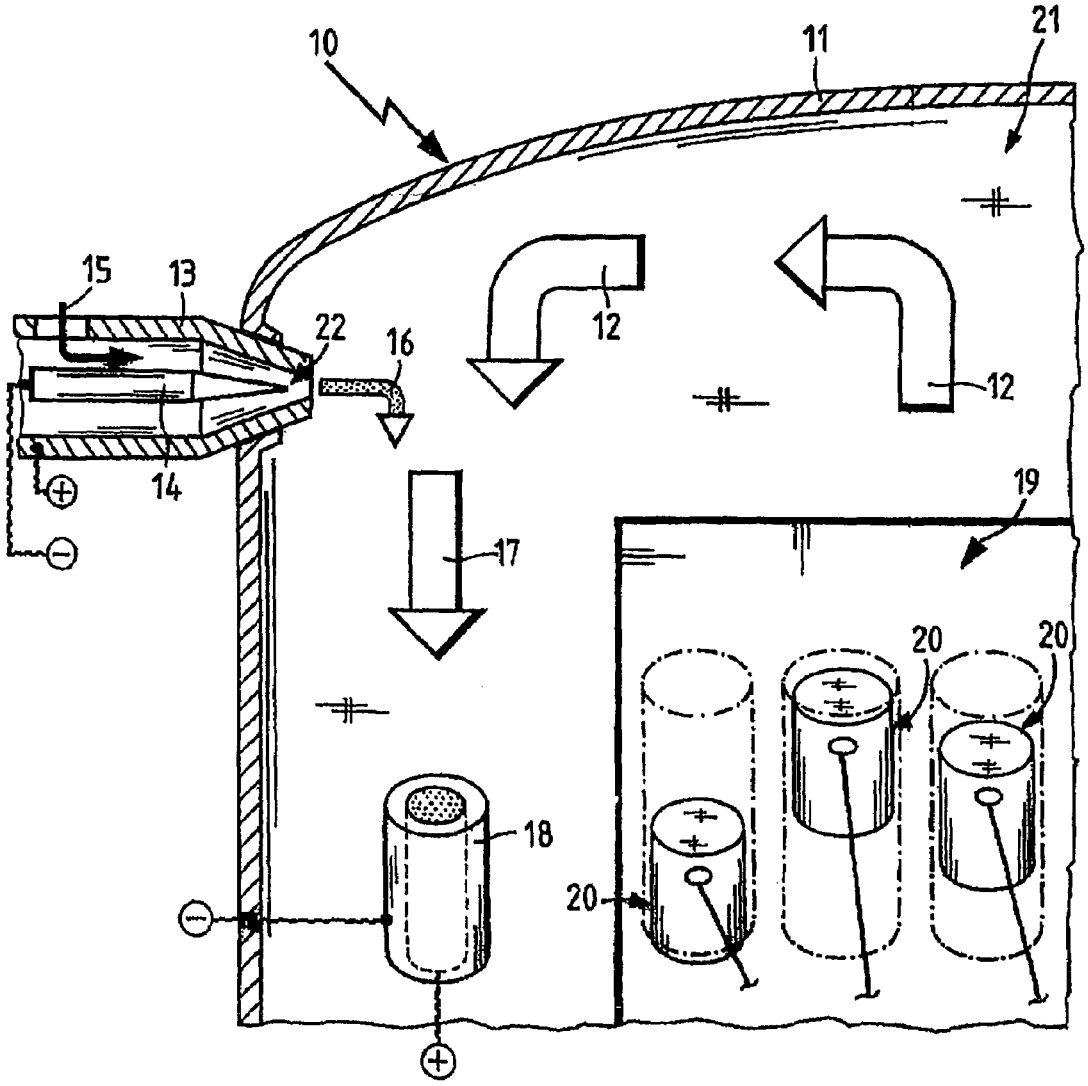
10
11
21
15
13
22
16
12
12
14
19
17
20
20
18
20

APPARATUS FOR SEPARATING AEROSOLS OR PARTICLES FROM GASES

CROSS REFERENCE TO RELATED APPLICATIONS

This application is a continuation of international patent application no. PCT/EP2003/007800, filed Jul. 17, 2003, designating the United States of America, and published in German as WO 2004/009243 on Jan. 29, 2004, the entire disclosure of which is incorporated herein by reference. Priority is claimed based on Federal Republic of Germany patent application no. DE 102 32 602.9, filed Jul. 18, 2002.

BACKGROUND OF THE INVENTION

This invention relates to an apparatus for separating aerosols or particles from a gas stream.

Published European patent application no. EP 685,635 discloses a device for an internal combustion engine with which oil or oil particles are removed from crankcase gases. This so-called crankcase venting has a vent line through which a medium may flow; at least one oil separator is provided in this vent line, and a return line for separating oil leads from this oil separator to the crankcase. The oil separator is an electric filter designed as a tubular electric filter. The electric filter consists of a discharge electrode arranged in the interior of the pipe with a medium flowing through it, an electric d.c. field being generated between the pipe wall and the discharge electrode for charging the oil droplets flowing through. The oil droplets are separated on the inside of the pipe through which they flow, forming an oil film there. This oil film flows in the direction of the oil pan. One disadvantage of this device may be regarded as the fact that the corona electrode is situated in the aerosol stream and thus there is the risk of soiling the electrode. This soiling alters the electrostatic conditions, which in turn alters the deposition effect. It is impossible to clean the electrode because of the built-in conditions.

In addition, published German patent application no. DE 196 42 218 describes an oil separating device, in particular for internal combustion engines of motor vehicles. It consists of an oil separator element arranged in a housing. The oil separator element has a first and a second electrode, each of which is connected to a high voltage source; the two electrodes have different polarities and are mounted in the flow path of the oil and gas mixture. With this arrangement, there is also the risk that the dirt particles might be deposited on the electrodes and thus greatly impair the effect of the separator.

SUMMARY OF THE INVENTION

The object of this invention is to provide an improved apparatus for separating aerosols or particles from gases.

Another object of the invention is to provide an apparatus for separating aerosols and/or particles from a gas stream which has a high degree of functionality.

A further object of the invention is to provide an apparatus for separating aerosols and/or particles from a gas stream which prevents soiling and/or contamination of the charge generator.

It is also an object of the invention to provide an apparatus for separating aerosols and/or particles from a gas which is particularly suited to separate entrained liquid oil from blow-by gases in an internal combustion engine.

These and other objects have been achieved in accordance with the present invention by providing an apparatus for separating aerosols or particles from a gas flow, comprising a flow housing through which a gas flow containing components to be separated passes, an electric separator arranged in the flow housing, and a corona electrode located upstream of the electric separator in the gas flow direction, in which the corona electrode is situated essentially outside of the gas flow, and there is an gaseous volumetric flow from the corona electrode into the gas flow for transporting charge carriers generated by the corona electrode into a charging zone in the flow housing.

The main advantage of this invention is that the corona electrode is essentially outside of the gas flow and thus no particles or liquids can be deposited on the corona electrode. The charge generated by the corona electrode is transported via a gaseous volumetric flow into the vicinity of the gases to be purified. The gaseous volumetric flow may be a flow of air, or it may be a volumetric flow of an inactive, unreactive or inert gas such as nitrogen.

Another advantage of the apparatus according to the invention is that the generation of a charge is not subject to the constant requirement to adjust the electric field to varying distances due to the soiling of the electrode and/or possible burn-off. With the systems known in the past, it is necessary to vary the electric field depending on the degree of soiling in order to maintain the separation effect. This can be avoided due to the construction of the presently described invention.

In accordance with one embodiment of the present invention, the corona electrode is surrounded by an outside electrode. The electric field develops between these two electrodes. The electric charge carriers are diverted via an air volumetric flow between the corona electrode and the outside electrode.

In another embodiment of the present invention, the separator is a so-called cylinder condenser. It is comprised of at least two concentric hollow cylinders. It is of course also possible for the flow housing itself to be used as a condenser. In addition, multiple hollow cylinders arranged one inside the other or separator plates arranged in parallel may also be provided. Instead of the cylinder condenser, a plate condenser may also be used. Any separator design may be used, and the design can be adapted to the available installation space.

In accordance with another embodiment of the present invention, the flow housing is constructed as part of the crankcase of an internal combustion engine. Consequently, the aerosol separation device can be integrated into an internal combustion engine and is suitable for separating an oil aerosol from the crankcase gases of the engine.

In a refinement of this invention, the volume flow of air is also purified through an upstream filter. This filter assures that the airstream does not contain any entrained particles that could be deposited on the corona electrode.

It is also possible to construct the separator and/or the corona electrode in a plurality of stages. This allows a further increase in separation efficiency and/or optimization of the separation of different particle sizes.

In accordance with another embodiment of the present invention, an additional oil separator in the form of a cyclone, an impingement separator or a fiber separator may also be connected upstream of the electric separator. This may also serve to increase efficiency.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to an illustrative preferred embodiment depicted in the accompanying drawing FIGURE which is a schematic diagram of an apparatus for separating aerosols and/or particles from gases.

DETAILED DESCRIPTION OF PREFERRED EMBODIMENTS

The drawing FIGURE shows a schematically illustrated internal combustion engine 10 provided with a crankcase 11. The crankcase 11 encloses a cylinder block 19, at least in the upper area, in which the schematically illustrated cylinders are situated together with the respectively associated pistons 20. The so-called blow-by gas formed during the operation of the internal combustion engine flows into the hollow space 21 between the cylinder block and the crankcase 11. The blow-by gas then enters a separator 18 as indicted by the arrows 12 and 17 due to an applied vacuum. The blow-by gas is an aerosol stream, i.e., a stream of air contaminated with liquid.

The purpose of the separator 18 is to separate the air stream from the liquid and/or from the liquid components. The construction of the separator 18 resembles that of a cylinder condenser.

In the illustrative embodiment shown in the drawing, the separator is connected to a d.c. voltage source so that an electric field develops between the two cylinders. Upstream from the separator, a so-called charging unit is provided. The charging unit is comprised of an ion source and/or a corona electrode 14 and an outside electrode 13. Due to an electric voltage between the outside electrode and the corona electrode, a discharge occurs at the tip 22, i.e., charge carriers are generated. Other designs of the charging unit are also conceivable.

As indicated by arrow 15, an air volume stream is passed between the outside electrode and the corona electrode. This air volume stream moves outward at the tip 22 of the ion source. The ions or charge carriers generated because of the voltage are deposited on the droplets or on particles in the immediate surrounding area. The droplets, which thus become electrically charged, are deposited in the electric field in the separator 18. If desired, the air volumetric flow depicted according to the arrow 15 can be cleaned through a suitable filter system before entering the ion source. The filter system is a conventional commercially available particle filter. The influx of air is created by a slight excess pressure. The suction removal of the purified blow-by gas below the separator 18 takes place via a suitable vacuum system, which is known in general and will not be explained in greater detail here. Of course, a pump may alternatively be used to generate the vacuum.

The injection of charge carriers, i.e., the charge carrier stream 16, may be varied depending on the quantity of blow-by gas generated. The amount of variation is determined by the degree of aerosol separation required.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An apparatus for separating aerosols or particles from a gas flow within an internal combustion engine, said apparatus comprising:

a crankcase defining a flow housing through which a gas flow containing components to be separated passes, an electric separator arranged in said flow housing, wherein the electric separator is a cylinder condenser comprised of at least two concentrically arranged hollow cylinders, and an electric field prevails between the two hollow cylinders, and a corona electrode located upstream of said electric separator in the gas flow direction, wherein said corona electrode is surrounded by an outside electrode and is situated essentially outside of the gas flow, and a gaseous volumetric flow passes between the corona electrode and the outside electrode from the corona electrode into the gas flow for transporting charge carriers generated by the corona electrode into a charging zone in the flow housing.

2. An apparatus according to claim 1, wherein the gas flow comprises a stream of crankcase gases, and an oil aerosol is separated from the crankcase gases by the separator.

3. An apparatus according to claim 1, wherein the electric separator is constructed in a plurality of stages.

4. An apparatus according to claim 1, wherein the corona electrode is constructed in a plurality of stages.

5. An apparatus according to claim 1, wherein the electric separator or a part of the electric separator is formed by the flow housing.

6. An apparatus according to claim 1, wherein the corona electrode is located outside of the gas flow.

7. An apparatus according to claim 1, wherein the crankcase comprises a cylinder block and the gas flow flows in a hollow space between the cylinder block and a wall of the crankcase.

8. An apparatus according to claim 1, wherein the crankcase comprises a cylinder block and the electric separator is located in a hollow space between the cylinder block and a wall of the crankcase.

* * * * *